US006386862B1

(12) United States Patent
Fujita et al.

(10) Patent No.: US 6,386,862 B1
(45) Date of Patent: May 14, 2002

(54) CATALYTIC COMBUSTION APPARATUS

(75) Inventors: Tatsuo Fujita, Osaka; Yoshitaka Kawasaki, Nabari; Akira Maenishi, Toyonaka, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/526,604

(22) Filed: Mar. 16, 2000

(30) Foreign Application Priority Data

Mar. 16, 1999 (JP) ..... 11-070729

(51) Int. Cl.[7] ..... F23D 11/44; F23Q 11/00

(52) U.S. Cl. ..... 431/170; 431/11; 431/208; 431/268; 431/243; 431/326; 431/328

(58) Field of Search ..... 431/243, 328, 431/7, 350, 11, 76, 326, 268, 75, 170, 208

(56) References Cited

U.S. PATENT DOCUMENTS

| | | | | |
|---|---|---|---|---|
| 4,154,568 A | * | 5/1979 | Kendall et al. | 431/7 |
| 4,375,949 A | * | 3/1983 | Salooja | 431/7 |
| 4,459,126 A | * | 7/1984 | Krill et al. | 431/7 |
| 4,930,454 A | * | 6/1990 | Latty et al. | 431/7 |
| 5,707,148 A | * | 1/1998 | Visser et al. | 431/76 |
| 5,901,700 A | * | 5/1999 | Suzuki et al. | 431/328 |
| 5,938,427 A | * | 8/1999 | Suzuki et al. | |

FOREIGN PATENT DOCUMENTS

| | | | |
|---|---|---|---|
| DE | 197 39 704 | | 3/1998 |
| EP | 0 889 287 | | 1/1999 |
| EP | 0 962 697 | | 12/1999 |
| JP | 6-147419 | * | 5/1994 |
| WO | WO97/21957 | * | 6/1997 |
| WO | WO 98/26214 | | 6/1998 |

* cited by examiner

*Primary Examiner*—Carl D. Price
(74) *Attorney, Agent, or Firm*—Ratner & Prestia

(57) ABSTRACT

A mixed gas supply portion 1 for mixing fuel with air, a mixed gas ejection portion 2 for ejecting the mixed gas mixed by the mixed gas supply portion 1, a breathable first catalyst body 5 provided downstream of the mixed gas supply portion 2, a breathable second catalyst body 7 provided downstream of the first catalyst body 5, a separation board a 6 for increasing gas flow resistance provided between the first catalyst body 5 and the second catalyst body 7, a heat exchange portion 13 having a heated fluid passage 14 positioned on the peripheral part, a radiant heat reception portion 3 provided upstream of the first catalyst body 5 and integrated with the heat exchange portion 13, and a separation board b 8 and a separation board c 10 provided downstream of the second catalyst body 7 for increasing flow resistance of the mixed gas and/or the combustion gas thereof are provided, and the separation board a 6, the separation board b 8, the separation board c 10 and the heat exchange portion 13 are integrated.

14 Claims, 2 Drawing Sheets

CATALYTIC COMBUSTION APPARATUS

BACKGROUND OF THE INVENTION

1. Field of the Invention

The present invention relates to a catalytic combustion apparatus, for example, applied to hot water supply and heating for a household or business.

2. Description of the Related Art

Catalytic combustion apparatuses for catalytically combusting fuels using catalyst bodies of noble metal catalysts such as of platinum or palladium carried upon substrates such as cordierite and utilizing the heat generated during combustion for heating have been proposed (for example, Japanese Patent Laid-Open No. Hei6-147419). Such a catalytic combustion apparatus has been equipped with a heat exchange portion upstream of the honeycomb shaped catalyst body for exchanging heat utilizing radiant heat from the catalyst body, and a gaseous mixture of fuel and air has been supplied for catalytic combustion on the catalyst body after heating the catalyst body above its activation temperature for example by flaming the fuel using a spare burner to start catalytic combustion.

However, conventional catalytic combustion apparatuses have problems explained below. First, as the combustion temperature of catalytic combustion is low, in order to increase the amount of heat exchanged the catalyst body must be larger, so that it was difficult to realize downsizing of the apparatus as a whole. When downsizing of the whole apparatus is given up and a large catalyst body is used, stability of combustion tends to be insufficient especially at low combustion quantity, resulting in difficulty of widening of the adjustable combustion quantity range (TDR:Turn Down Ratio). On the other hand, when downsizing was attempted by minimizing the catalyst body, there was a problem that the temperature of the combustion body rose surpassing the limit of heat resistance.

There was also a problem that the method of detecting the condition of combustion based upon ion current in the flame as previously can not be applied, as catalytic combustion is a method of combustion without forming flame.

SUMMARY OF THE INVENTION

The present invention is directed to providing a catalytic combustion apparatus that carries out heat exchange more efficiently than previously, taking in consideration the problem of insufficient efficiency of heat exchange in conventional catalytic combustion apparatuses.

The present invention is also directed to providing a catalytic combustion apparatus with wide adjustable combustion quantity range (TDR), taking in consideration the problem that the adjustable combustion quantity range (TDR) was not wide enough in conventional catalytic combustion apparatuses.

The present invention is also directed to providing a downsized compact catalytic combustion apparatus, taking in consideration the problem that conventional catalytic combustion apparatuses were not downsized and compact.

The present invention is also directed to providing a catalytic combustion apparatus in which the catalyst body most upstream does not surpass the limit of heat resistance, taking in consideration the problem that the catalyst body most upstream does surpass the limit of heat resistance in conventional catalytic combustion apparatuses.

The present invention is further directed to providing a catalytic combustion apparatus capable of detecting the condition of combustion, taking in consideration the problem that conventional catalytic combustion apparatuses could not detect the condition of combustion.

In order to solve the problems described above, one aspect of the present invention is a catalytic combustion apparatus which, comprises:

a mixed gas supply portion for mixing fuel with air;

a breathable first catalyst body provided downstream of said mixed gas supply portion;

a breathable second catalyst body provided downstream of said first catalyst body;

a separation board for increasing gas flow resistance, said separation board being provided between said first catalytic body and said second catalyst body;

a heat exchange portion having a heated fluid passage, said heat exchange portion being provided on the peripheral part;and a radiant heat reception portion connected to said heat exchange portion, in which said separation board is connected to said heat exchange portion.

Another aspect of the present invention is a catalytic combustion apparatus, which comprises:

a mixed gas supply portion for mixing fuel with air;

a breathable first catalyst body provided downstream of said mixed gas supply portion;

a breathable second catalyst body provided downstream of said first catalyst body;

a heat exchange portion having a heated fluid passage, said heat exchange portion being provided on the peripheral part; and a radiant heat reception portion connected to said heat exchange portion, in which gas flow resistance per unit area of said first catalyst body is smaller than gas flow resistance per unit area of said second catalyst body.

Still another aspect of the present invention is a catalytic combustion apparatus, which comprises:

a mixed gas supply portion for mixing fuel with air;

a breathable first catalyst body provided downstream of said mixed gas supply portion;

a breathable second catalyst body provided downstream of said first catalyst body;

a heat exchange portion having a heated fluid passage, said heat exchange portion being provided on the peripheral part; and a radiant heat reception portion connected to said heat exchange portion, in which heat exchange coefficient of said first catalyst body is larger than heat exchange coefficient of said second catalyst body.

Yet another aspect of the present invention is a catalytic combustion apparatus, which comprises:

a mixed gas supply portion for mixing fuel with air;

a breathable first catalyst body provided downstream of said mixed gas supply portion;

a breathable second catalyst body provided downstream of said first catalyst body; and a gas sensor provided between said first catalyst body and said second catalyst body.

DESCRIPTION OF THE PREFERRED EMBODIMENTS

Embodiments of the present invention will be described below with reference to drawings.

(Embodiment 1)

Figure 1:
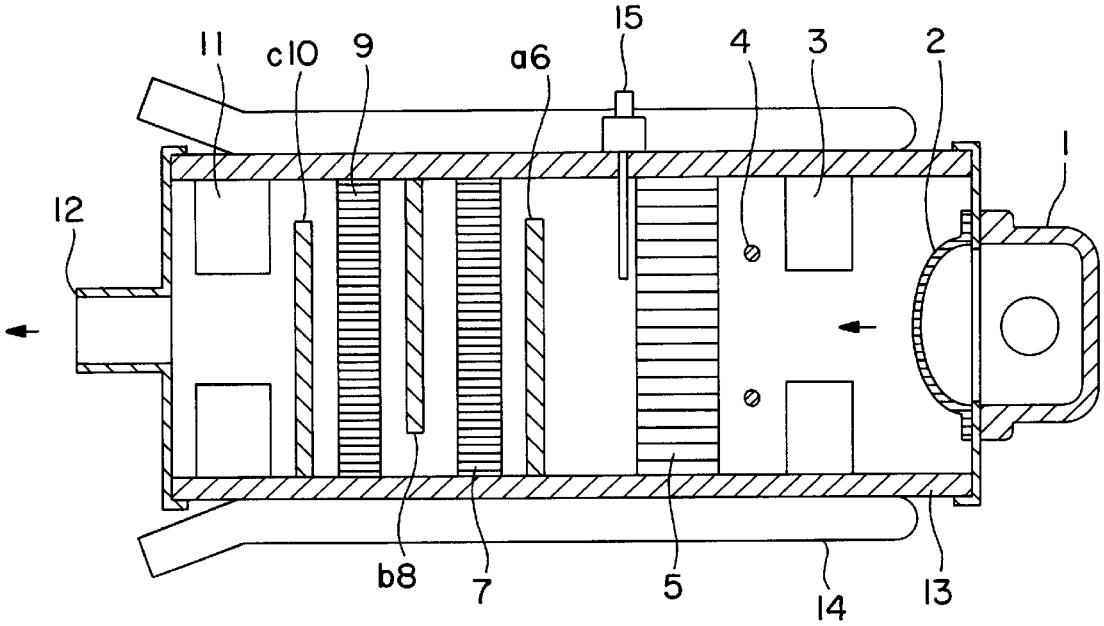
FIG. 1 is a cross sectional view of the catalytic combustion apparatus of the embodiment 1 of the present invention.

First, the construction of the catalytic combustion apparatus of embodiment 1 of the present invention is described using FIG. 1. FIG. 1 is the cross sectional view of the catalytic combustion apparatus of embodiment 1. The catalytic combustion apparatus has an oblong rectangular form and is provided with a passage 14 for heated fluid on the upper and the lower side surfaces of the rectangular form. Incidentally, though the catalytic combustion apparatus is of a rectangular form in this embodiment for convenience of explanation, the catalytic combustion apparatus of the present invention is not limited by its form, and may be of a cylindrical form for example.

The catalytic combustion apparatus of embodiment 1 is equipped with a mixed gas supply portion 1, a mixed gas ejection portion 2, radiant heat reception portion 3, a heater 4, a first catalyst body 5, a separating board a 6, a second catalyst body 7, a separating board b 8, a third catalyst body 9, a separating board c 10, a waste heat recover portion 11, a vent 12, a heat exchange portion 13, and a heated fluid passage 14. As shown in FIG. 1, the heat exchange portion is provided on a peripheral portion of the catalytic combustion apparatus. The catalytic combustion apparatus of embodiment 1 uses the separating board a 6 as the separating board, and the separation board b 8 is used as the second separating board of another embodiment. And an oxygen sensor 15 is positioned between the first catalyst body 5 and the separating board a 6. Though the oxygen sensor 15 is positioned between the first catalyst body 5 and the separating board a 6 in FIG. 1, the oxygen sensor 15 may not be limited to be positioned between the first catalyst body 5 and the separating board a 6. The oxygen sensor 15 should only be positioned between the first catalyst body 5 and the second catalyst body 7. Also, the oxygen sensor 15 is an example of a gas sensor and the gas sensor may not be limited to be an oxygen sensor 15 but may be a gas sensor such as a CO (carbon monoxide) sensor and an HC (hydrocarbon) sensor.

The first catalyst body 5, the second catalyst body 7, and the third catalyst body 9 are catalysts of noble metals such as palladium and platinum carried upon substrates of breathable cordierite honeycomb. The number of honeycomb cells per unit area of the first catalyst body 5 is fewer than that of the second catalyst body 7. The substrate of the first catalyst body 5 may be metal or silicon carbide instead of cordierite honeycomb. The radiant heat reception portion 3 and the waste heat recovery portion 11 are in the form of fins substantially perpendicular to the gas flow direction, and the separation board a 6, the separation board b 8, and the separation board c 10 are flatboards substantially perpendicular to the gas flow direction, all being integrated with the heat exchange portion 13. The separation board a 6, the separation board b 8, and the separation board c 10 are means for increasing gas flow resistance, and the openings of the separation board a 6, the separation board b 8, the separation board c 10, and the heat exchange portion 13 are so positioned that the combustion gas may meander. The heater 4 is provided upstream of the first catalyst body 5, with all or part of its heat radiant surface arranged to face the first catalyst body 5.

Next workings of the catalytic combustion apparatus of embodiment 1 of the present invention is explained. First, when starting combustion, electricity is turned on to the heater 4 to p reheat the first catalyst body 5 above the activation temperature, then electricity to the heater 4 is turned off, mixed gas is supplied from the mixed gas supply portion 1 and is ejected from the mixed gas ejection portion 2, and catalytic combustion is started in the first catalyst body 5. During catalytic combustion the first catalyst body 5 becomes red-heat and radiant energy is radiated. This radiant energy is radiated through the radiant heat reception portion 3, etc. or directly to the heat exchange portion 13, where it is absorbed and converted into thermal energy again. Further, the thermal energy is trans erred by heat conduction through the heat exchange portion 13 past the heated fluid passage 14, and by convection heat transfer to the heated fluid in the heated fluid passage 14. As radiation heat transfer does not disturb gas flow, it does not interfere with combustion reaction in the first catalyst body 5, so that stability of combustion can be secured even when the amount of heat exchange to the heated fluid is increased. the combustion quantity is further increased, the fuel becomes to partially reach the third catalyst body 9 and start catalytic combustion in the third catalyst body 9. By meandering through the separation board a 6, the separation board b 8, and the separation board c 10, the combustion gas can prevent boundary layers from developing to improve convection heat transfer characteristics, as well as increase the effective area of heat transfer. In other words, heat transfer performance of the separation board a 6, the separation board b 8, and the separation board c 10 can be improved remarkably by the radiant energy radiantly heat-transferred from the fist catalyst body 5, the second catalyst body 7, and the third catalyst body 9. Although these effects may be obtained with the separation board a 6 alone, the more the separation boards are there, the greater the effects grow.

The combustion gas passed through the separation board c 10 is discharged out through the vent 12 after the waste heat is recovered in the waste heat recovery portion 11. Further, by providing the waste heat recovery portion 11 upstream of the vent 12 so as to be integrated with the heat exchange portion 13, heat resistance can be reduced and the waste heat can be recovered efficiently, resulting in higher performance of heat transfer to the heated fluid and promotion of efficiency improvement of the apparatus.

Thus, adjustable combustion quantity range (TDR) can be widened by carrying out catalytic combustion with the first catalyst body 5 alone at lower combustion quantity, and with not only the first catalyst body 5 but also the second catalyst body 7 and/or the third catalyst body 9 at higher combustion quantity. Also, downsizing of the apparatus is possible as a catalytic combustion apparatus integrated with a high load type heat exchange portion can be realized by utilizing radiant heat transfer to improve convection heat transfer characteristics without interfering with combustion reaction.

Incidentally, though catalytic combustion is capable of lean burning and can be applied to a wide range of mixed gas concentration, it generates carbon monoxide (CO) and unburnt hydrocarbons (HC) when combustion is carried out at a gas concentration that causes incomplete combustion (lack of oxygen). To avoid this, the combustion gas is surveyed for oxygen with an oxygen sensor 15, and when no oxygen is detected in the combustion gas and combustion is judged to lack in oxygen, the mixed gas concentration is controlled to the lower side. By providing the oxygen sensor 15 between the first catalyst body 5 and the second catalyst body 7, it becomes possible to control heat radiation and gas diffusion and improve precision of detection. As described above, the oxygen sensor 15 is an example of the gas sensor, and the gas sensor for detecting combustion with lack of oxygen may not be limited to an oxygen sensor 15 but may be a gas sensor such as a CO sensor and an HC sensor. Also, in case of abnormal combustion other than combustion with lack of oxygen, the abnormality can be detected with a gas sensor such as a CO sensor and an HC sensor provided between the first catalyst body 5 and the second catalyst body 7, and safety can be secured by stopping combustion.

Also, as described above, by providing the first catalyst body 5 with fewer number of honeycomb cells per unit area than the second catalyst body 7, combustion reaction in the first catalyst body 5 can be suppressed so as to lower the surface temperature of the catalyst, which typically tends to be high temperature at a high combustion quantity, below the limit temperature of heat resistance, while combustion reaction in the second catalyst body 7 is promoted. Further, although in embodiment 1 the first catalyst body 5 and the second catalyst body 7 are honeycomb type catalyst bodies, and the first catalyst body 5 is provided with fewer number of honeycomb cells per unit area than the second catalyst body 7, the first catalyst body 5 and/or the second catalyst body 7 are not limited to be honeycomb type catalyst bodies, and even in the case where they are not honeycomb type catalyst bodies, similar effect may be obtained by adjusting the gas flow resistance per unit area of the first catalyst body 5 smaller than that of the second catalyst body 7.

Next, by adjusting heat transfer rate of the first catalyst body 5 higher than that of the second catalyst body 7, temperature distribution of the first catalyst body 5 during catalytic combustion can be made uniform so as to lower the surface temperature of the catalyst, which typically tends to be high at a high combustion quantity, below the limit temperature of heat resistance, while combustion reaction in the second catalyst body 7 is promoted. In embodiment 1, as an example, heat transfer coefficient of the first catalyst body 5 is adjusted higher than that of the second catalyst body 7 by forming the substrate of the first catalyst body 5 with metal or silicon carbide, and the substrate of the second catalyst body 7 with ceramics.

Although in the catalytic combustion apparatus of FIG. 1 a heater 4 is provided upstream of the first catalyst body 5, which is used to activate the first catalyst body 5, by providing another heater, not shown in FIG. 1, downstream of the first catalyst body 5 so that part of its heat radiation surface may face the first catalyst body 5, radiation heat transfer from the heater downstream can be utilized effectively to reduce the time for preheating the first catalyst body 5 to the activation temperature, resulting in improvement of starting performance.

Further, by using linear sheathed heaters as the heater 4 upstream or the heater down stream, heat stress can be uniformed to suppress disconnection of the heaters and improve the life, and cost reduction may be realized as well.

Moreover, by covering all or part of the separation board a 6, the separation board b 8, the separation board c 10, the radiation reception unit 3, the heat receiving surface of the heat exchange portion 13, and the waste heat recovery portion 11 with a highly radiant material, radiation heat transfer efficiency from the first catalyst body 5, the second catalyst body 7, and the third catalyst body 9 can be improved.

(Embodiment 2)

Figure 2:
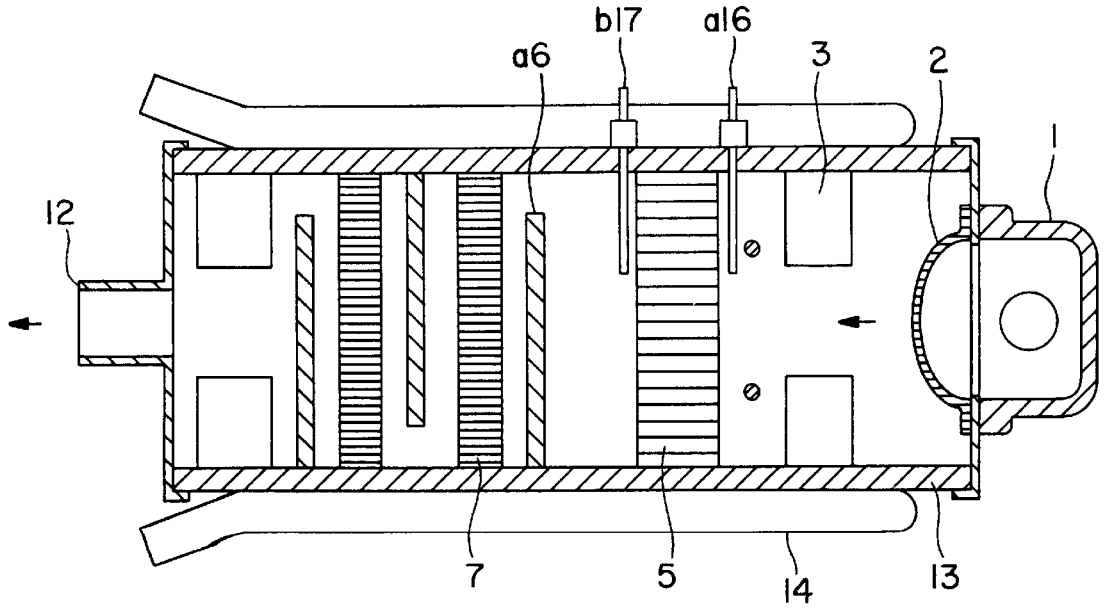
FIG. 2 is a cross sectional view of the catalytic combustion apparatus of the embodiment 2 of the present invention.

Next, the construction of a catalytic combustion apparatus of embodiment 2 of the present invention is explained together with its operation using FIG. 2.

FIG. 2 is a cross sectional view of the catalytic combustion apparatus of embodiment 2. While in embodiment 1 the oxygen sensor 15 is provided between the first catalyst body 5 and the separation board a 6, in embodiment 2 a temperature sensor a 16 is provided upstream of the first catalyst body 5 and a temperature sensor b 17 is provided between the first catalyst body 5 and the separation board a 6. The temperature sensor b 17 is not limited to be provided between the first catalyst body 5 and the separation board a 6, but the temperature sensor b 17 should only be provided between the first catalyst body 5 and the second catalyst body 7.

Although operation of the catalytic combustion apparatus of embodiment 2 is almost the same as that of the catalytic combustion apparatus of embodiment 1, in embodiment 2 it was first noted that the temperature detected by the temperature sensor b 17 provided between the first catalyst body 5 and the separation board a 6 is proportional to combustion quantity, and detection of combustion quantity is realized accordingly. Although correct detection of combustion quantity has been said to be difficult as catalytic combustion is a method of combustion without forming flame, highly reliable detection of combustion quantity is made possible by this method.

Next, utilizing not only temperature detected by the temperature sensor b 17 but also temperature detected by the temperature sensor a 16 provided upstream of the first catalyst body 5, it is noted that when gas concentration of the mixed gas increases at a constant combustion quantity temperature detected by the temperature sensor a 16 rises and temperature detected by the temperature sensor b 17 lowers, and gas concentration of the mixed gas is detected accordingly based upon the temperature difference between them. Although detection of gas concentration has been said to be difficult even with combustion with flame, highly reliable detection of gas concentration can be realized and detection of abnormal combustion such as combustion with lack of oxygen becomes possible by this method.

(Embodiment 3)

Figure 3:
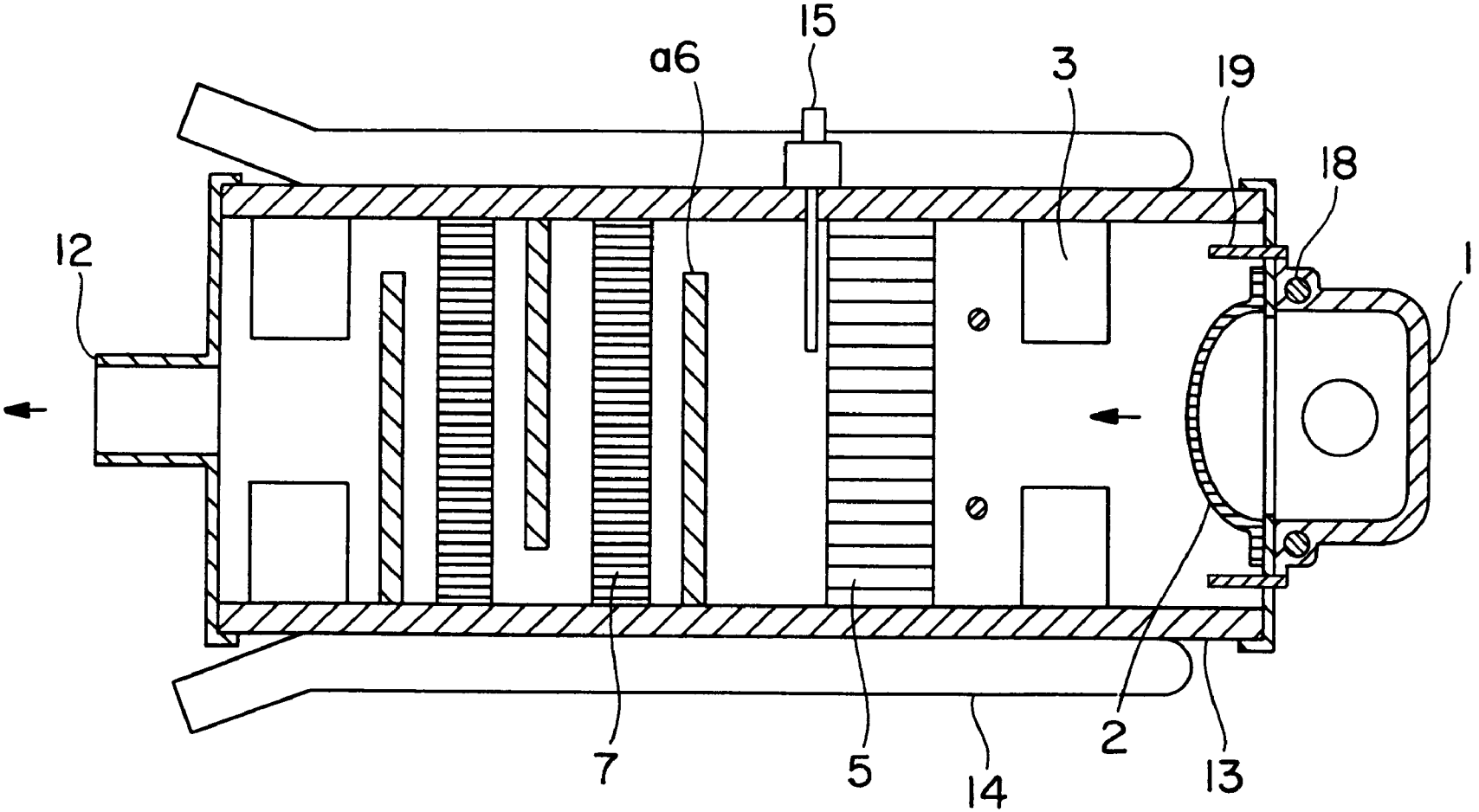
FIG. 3 is a cross sectional view of the catalytic combustion apparatus of the embodiment 3 of the present invention.

Next, the construction of a catalytic combustion apparatus of embodiment 3 of the present invention is explained together with its operation using FIG. 3.

FIG. 3 is a cross sectional view of the catalytic combustion apparatus of embodiment 3. Different from embodiments 1 and 2, in embodiment 3 the mixed gas supply portion 1 is provided with an evaporation heater 18, and the catalytic heat radiator 19 provided upstream of the first catalyst body 5 is integrated with the mixed gas supply portion 1.

Although operation of the catalytic combustion apparatus of embodiment 3 is almost the same as that of the catalytic combustion apparatus of embodiment 1, liquid fuel is used in embodiment 3 which is evaporated by the evaporation heater 18, and the evaporated fuel is mixed with air in the mixed gas supply portion 1 and ejected from the mixed gas ejection portion 2. Also, by having a part of the mixed gas undergo catalytic combustion in the catalytic heat radiator 19, the heat of reaction is recovered through heat transfer to the mixed gas supply portion 1 integrated with the catalytic heat radiator 19, resulting in reduction of consumption of electricity for the evaporation heater 18. Although recovery of heat of reaction of catalytic combustion to the mixed gas supply portion 1 has been said to be difficult while catalytic combustion has the advantage of generating little nitrogen oxides (NOx) as it is a lower temperature reaction compared with combustion with flame, this method enables effective heat recovery and realizes energy saving of the apparatus.

Although the radiant heat reception portion 3, the separation board a6, the separation board b 8, the separation board c 10, and the waste heat recovery portion 11 are integrated with the heat exchange portion 13 in embodiments 1–3 described above, the radiant heat reception portion 3, the separation board a 6, the separation board b 8, the separation board c 10, and the waste heat recovery portion 11 may also not be integrated with the heat exchange portion 13 but may be formed separately and closely bound later. In a word, the radiant heat reception portion 3, the separation board a 6, the separation board b 8, the separation board c 10, and the waste heat recovery portion 11 have only to be closely bound to the heat exchange portion 13. Similarly, although the catalytic heat radiator 19 is integrated with the mixed gas supply portion 1 in embodiment 3 described above, the catalytic heat radiator 19 may also not be integrated with the mixed gas supply portion 1 but the catalytic heat radiator 19 may be formed separately and closely bound later. In a word, the catalytic heat radiator 19 has only to be closely bound to the mixed gas supply portion 1. Incidentally, the term "connected" is used to include "integrated" and "closely bound" as described above.

Although the radiant heat reception portion 3 is provided upstream of the first catalyst body 5 in embodiments 1–3 described above, the radiant heat reception is not limited to be provided upstream of the first catalyst body 5.

from the above explanation, the present invention provides a catalytic combustion apparatus that implements heat exchange more effectively than before.

Also, the present invention provides a catalytic combustion apparatus with a wide adjustable combustion quantity range (TDR).

Also, the present invention provides a downsized compact catalytic combustion apparatus.

Also, the present invention provides a catalytic combustion apparatus of which the catalyst body most upstream does not surpass the limit of heat resistance.

Further, the present invention provides a catalytic combustion apparatus capable of detecting the condition of combustion.

What is claimed is:

1. A catalytic combustion apparatus, comprising:

a mixed gas supply portion for mixing fuel with air;

a porous first catalyst body provided downstream of said mixed gas supply portion;

a porous second catalyst body provided downstream of said first catalyst body;

a separation board for increasing gas flow resistance, said separation board being provided between said first catalytic body and said second catalyst body;

a heat exchange portion having a heated fluid passage, said heat exchange portion being provided on a peripheral portion of the catalytic combustion apparatus;

a radiant heat reception portion connected to said heat exchange portion, and projecting from an inner surface of said heat exchange portion to an inside portion, and a shape of said radiant heat reception portion being fin-like in shape; and said separation board connected to said heat exchange portion.

2. The catalytic combustion apparatus as set forth in claim 1, comprises a second separation board connected to said heat exchange portion and provided downstream of said second catalyst body, with which combustion gas that has passed through said separation board meanders to increase gas flow resistance.

3. A catalytic combustion apparatus, comprising:

a mixed gas supply portion for mixing fuel with air;

a porous first catalyst body provided downstream of said mixed gas supply portion;

a porous second catalyst body provided downstream of said first catalyst body;

a heat exchange portion having a heated fluid passage, said heat exchange portion being provided on a peripheral portion of the catalytic combustion apparatus;

a radiant heat reception portion connected to said heat exchange portion, in which gas flow resistance per unit area of said first catalyst body is smaller than gas flow resistance per unit area of said second catalyst body; and wherein said second catalyst body has a shape that is the same as a shape of said first catalyst body.

4. The catalytic combustion apparatus as set forth in claim 1, characterized in that gas flow resistance per unit area of said first catalyst body is smaller than gas flow resistance per unit area of said second catalyst body.

5. The catalytic combustion apparatus as set forth in claim 3 or 4, characterized in that said first catalyst body and said second catalyst body are honeycomb cell type catalyst bodies, and the number of cells per unit area of said first catalyst body is smaller than the number of cells per unit area of said second catalyst body.

6. A catalyst combustion apparatus, comprising:

a mixed gas supply portion for mixing fuel with air;

a porous first catalyst body provided downstream of said mixed gas supply portion;

a porous second catalyst body provided downstream of said first catalyst body;

said second catalyst body having a shape that is the same as a shape of the first catalyst body, and said first and second catalyst bodies being free-of fins extending within each catalyst body;

a heat exchange portion having a heated fluid passage, said heat exchange portion being provided on a peripheral portion of the catalytic combustion apparatus; and a radiant heat reception portion connected to said heat exchange portion, in which a heat exchange coefficient of said first catalyst body is larger than a heat exchange coefficient of said second catalyst body.

7. The catalytic combustion apparatus as set forth in claim 1 or 2, characterized in that the heat transfer coefficient of said first catalyst body is larger than the heat transfer coefficient of said second catalyst body.

8. The catalytic combustion apparatus according to any one of claim 1, 3, or 6 comprising a gas sensor provided between said first catalyst body and said second catalyst body.

9. The catalytic combustion apparatus according to any one of claim 1, 3, or 6 comprising a temperature sensor provided between said first catalyst body and said second catalyst body.

10. The catalytic combustion apparatus as set forth in claim 9 comprises a second temperature sensor provided upstream of said first catalyst body.

11. The catalytic combustion apparatus according to any one of claim 1, 3, or 6 comprising a waste heat recovery portion provided upstream of a vent and connected to said heat exchange portion.

12. The catalytic combustion apparatus according to any one of claim 1, 3, or 6 comprising a heater provided upstream of said first catalyst body, and positioned so that at least a part of its heat radiating surface faces said first catalyst body.

13. The catalytic combustion apparatus according to any one of claim 1, 3, or 6 characterized in that at least a part of said radiant heat reception portion and said heat exchange portion are covered with a highly radiant material.

14. The catalytic combustion apparatus according to any one of claim 1, 3, or 6 wherein:

the fuel mixed with air on said mixed gas supply portion is a liquid fuel;

said mixed gas supply portion has an evaporation heater for evaporating said liquid fuel, and mixing the fuel evaporated by the evaporation heater with air; and a catalytic heat radiating body is disposed upstream of said first catalyst body and connected to said mixed gas supply portion.

* * * * *